US006229496B1

(12) United States Patent
Eriksson

(10) Patent No.: US 6,229,496 B1
(45) Date of Patent: May 8, 2001

(54) MULTIPLE ELEMENT ANTENNA FROM A SINGLE PIECE

(75) Inventor: Stefan G. Eriksson, Timmernabben (SE)

(73) Assignee: Radiovector U.S.A., LLC, Rockford, IL (US)

( * ) Notice: Subject to any disclaimer, the term of this patent is extended or adjusted under 35 U.S.C. 154(b) by 0 days.

(21) Appl. No.: 09/566,418

(22) Filed: May 5, 2000

(51) Int. Cl.[7] ..... H01Q 9/28
(52) U.S. Cl. ..... 343/795; 343/789
(58) Field of Search ..... 343/700 MS, 795, 343/789, 810, 797, 812, 813, 814, 815, 816, 817; H01Q 9/28, 1/42, 21/12

(56) References Cited

U.S. PATENT DOCUMENTS

| | | | | |
|---|---|---|---|---|
| 2,978,703 | | 4/1961 | Kuecken | 343/803 |
| 4,498,085 | | 2/1985 | Schwarzmann | 343/795 |
| 5,418,545 | | 5/1995 | Pantsios et al. | 343/795 |
| 5,532,707 | | 7/1996 | Klinger et al. | 343/793 |
| 5,724,051 | | 3/1998 | Mailandt et al. | 343/795 |
| 5,909,195 | * | 6/1999 | Merenda | 343/815 |
| 5,936,590 | | 8/1999 | Funder | 343/795 |
| 6,005,522 | * | 12/1999 | Arias et al. | 343/700 MS |
| 6,020,861 | | 2/2000 | Jonsson et al. | 343/800 |
| 6,034,649 | | 3/2000 | Wilson et al. | 343/795 |

* cited by examiner

*Primary Examiner*—Tho Phan
(74) *Attorney, Agent, or Firm*—Leydig, Voit & Mayer, Ltd.

(57) ABSTRACT

An antenna system comprising a plurality of dipole elements and a single support formed from a single piece of material. The plurality of dipole elements is attached to a reflector plate and forms horizontally or vertically stacked radiation elements. Tabs centrally located between the support and the dipole elements are bent at an angle to form a symmetrical axis in the center of a slot formed by the plurality of dipole elements to attenuate the radiation caused by current flowing around the slot. The plurality of dipole elements are selected to achieve different radiation patterns and can be formed into different shapes to achieve different lobe shapes.

9 Claims, 11 Drawing Sheets

MULTIPLE ELEMENT ANTENNA FROM A SINGLE PIECE

FIELD OF THE INVENTION

This invention relates generally to antenna systems and, more articularly, relates to broadband antennas.

BACKGROUND OF THE INVENTION

Broadband antennas used in wireless telecommunication systems are designed to receive or transmit linear polarized electromagnetic signals. The sense or direction of linear polarization is measured from a fixed axis and can range from horizontal polarization (90 degrees) to vertical polarization (0 degrees). Many broadband antennas are designed to employ dipole elements to receive or transmit the signals. These elements are mounted above an artificial ground plane, which is typically an electrically conducting plate, and the elements are connected together via feed lines. These feed lines are often in the form of coaxial cable.

The dipole elements are typically made from multiple pieces and soldered or welded together. As the number of dipole elements is increased, the manufacture of the antenna increases in complexity, time-consumption, and expense. For high frequency operation, the expense increases further due to the tolerances required for operation in the desired frequency range. What is needed is a way to economically produce the elements and the antenna assembly.

SUMMARY OF THE INVENTION

In view of the foregoing, a multi-dipole element is manufactured from a single sheet of a low loss conducting material. The multi-dipole element may be stamped, punched, cut, or etched and then bent into the proper shape or alternatively die-cast. The multi-dipole element forms horizontally or vertically stacked radiation elements and the support. The multi-dipole element is attached to a reflector plate and the element is assembled to the feed line perpendicular to the reflector plate.

At the center of each feed of the multi-dipole element is a tab that is bent at either an upward angle or a downward angle and the tabs form a symmetrical axis in the center of a slot formed by the multi-dipole element. The tabs attenuate the radiation caused by the slot.

Several dipoles can be added to achieve different radiation patterns. The dipole elements can also be formed into different shapes to achieve different lobe shapes.

Additional features and advantages of the invention will become more apparent from the following detailed description of illustrative embodiments when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
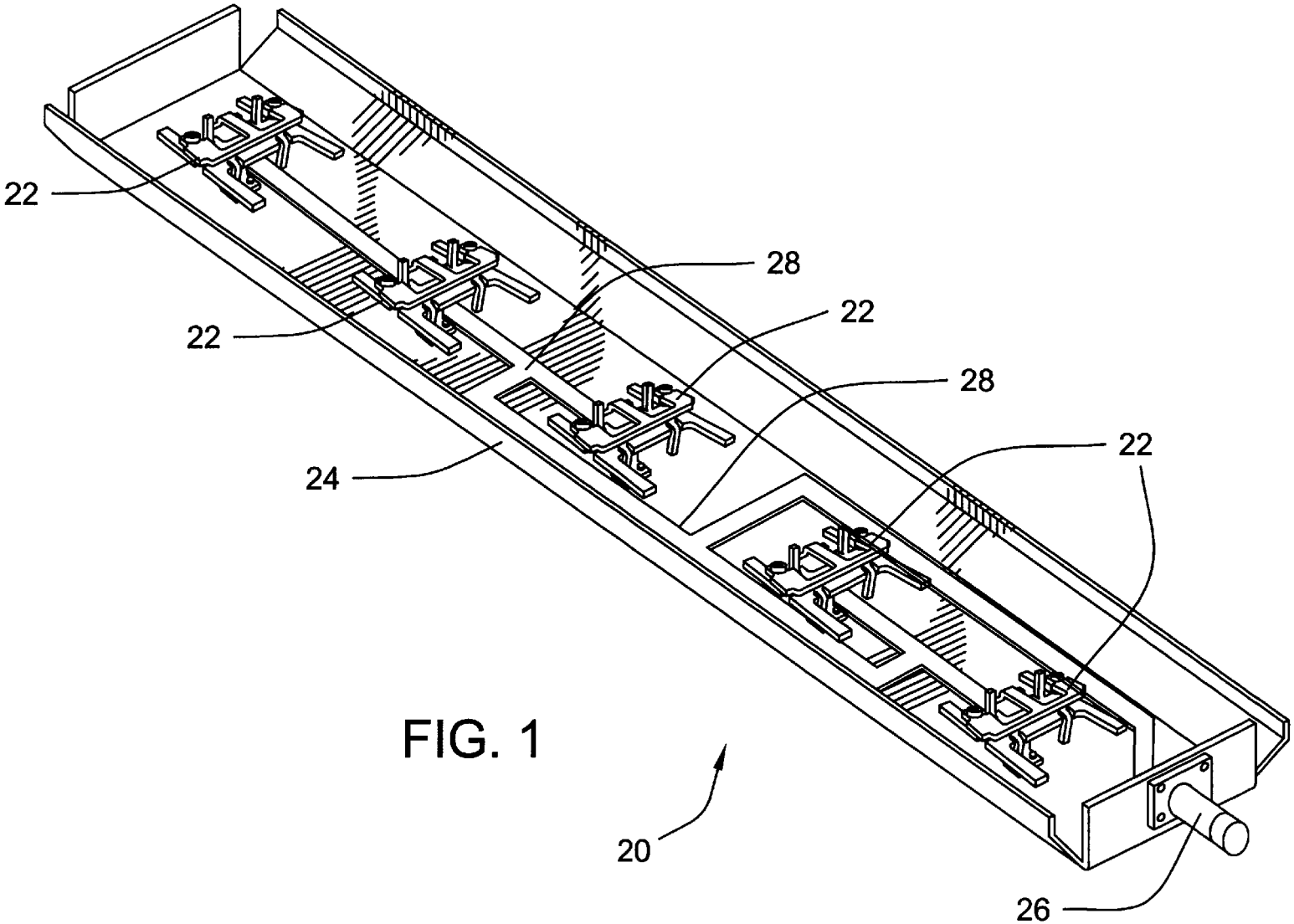
FIG. 1 is a perspective view of an antenna system according to the instant invention.

The antenna system 20 in FIG. 1 has multi-dipole elements 22 attached to a reflector plate 24, which is typically made from aluminum extrusions or other conducting metal. The multi-dipole elements 22 are connected to a connector 26 via a low loss transmission feed line 28. The feed line 28 may be brass, aluminum, or any other conducting material and it uses air as insulation. The number of multi-dipole elements 22 is selected to achieve different radiation patterns. A cover (not shown) can be removably attached to the reflector plate 24.

Figure 2B:
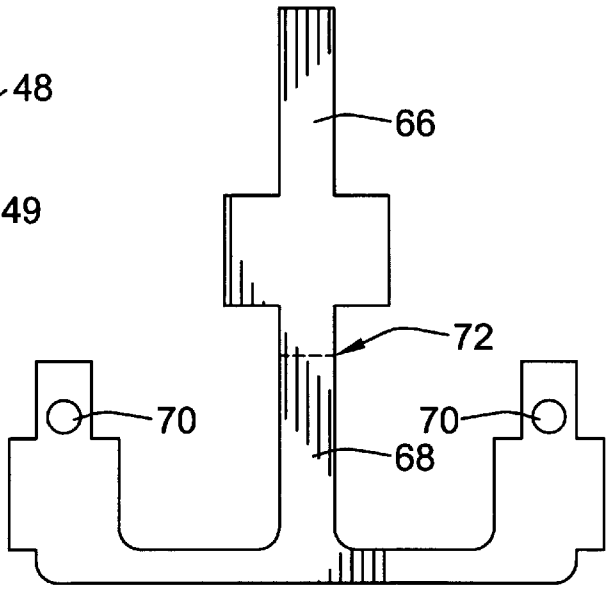
FIG. 2 is a plan view of a multi-dipole element and a portion of a feed line according to one embodiment of the invention.
Figure 2A:
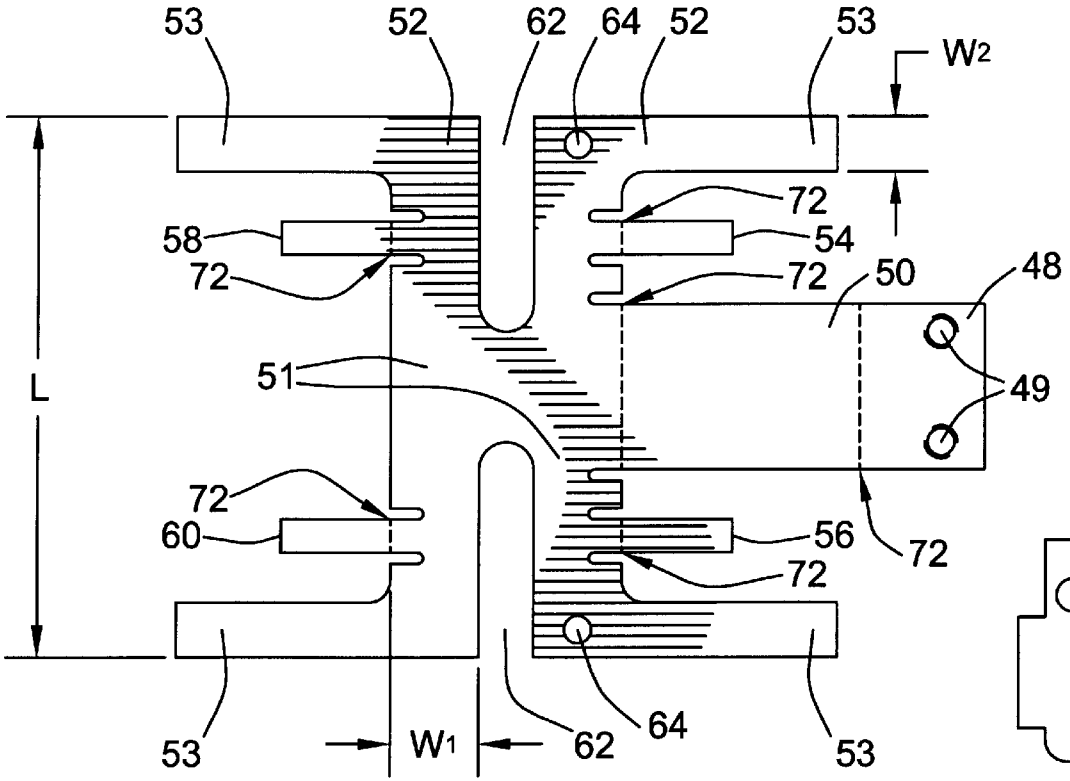
Figure 3A:
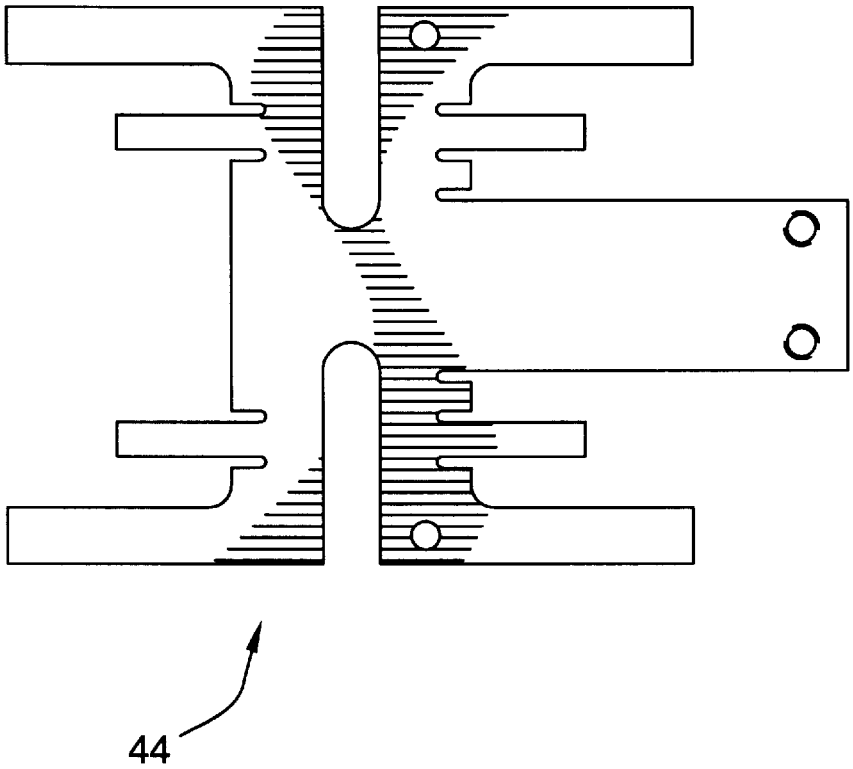
FIG. 3 is a plan view of a further multi-dipole element and portion of a feed line.
Figure 3B:
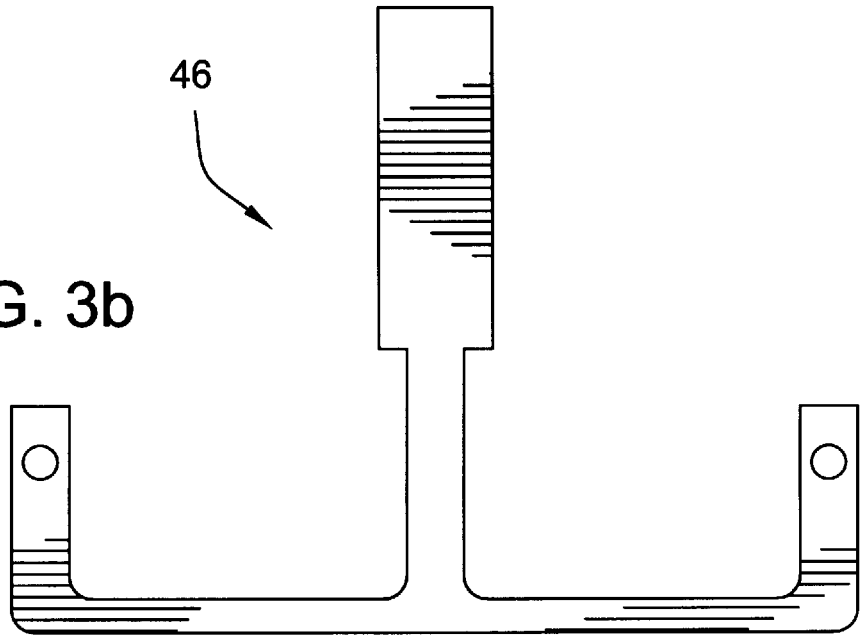

The multi-dipole element 22 and a portion of the feed line 28 are made from a flat sheet of material as illustrated in FIG. 2 and FIG. 3. The multi-dipole element 40 and feed line portion 42 are punched, cut, or etched from a 10 low loss conducting material. In one embodiment, the multi-dipole element 40 is made from aluminum and the feed line portion 42 is made from brass. The widths $W_1$ and $W_2$ and length L is chosen to provide adequate bandwidth for the desired frequency band of operation as is known in the art. The multi-dipole element and feed line portion can be formed into any shape to achieve different lobe shapes. The power flow can be adjusted by changing the feed line portion 42 and overall feed line length. For example, as shown in FIG. 3., the multi-dipole element 44 and feed line portion 42 can be made longer and have a shorter width to operate within a different frequency range. In other embodiments, the vertical portion 66 of the feed line portion 42 may be located at an end of the horizontal portion 68 or at any other position along the length of the horizontal portion 68 for making a dipole element that is not center fed.

For purposes of explanation, the multi-dipole element forms two dipoles with a common support structure. It should be understood that any number of dipole elements may be used. The multi-dipole element 40 has a mounting support portion 48, a multi-dipole support 50, a radiation portion 52, and tabs 54, 56, 58, 60 located an equidistant between the arms 53 of the radiation portion 52 and the center of the radiation portion 52. It should be noted that the tabs 54, 56, 58, 60 may be positioned at other locations along the legs 51 of the radiation portion 52. A slot 62 is formed between the sections of the radiation portion 52. Mounting locations 64 are provided on the radiation portion 52. The feed line portion 42 has a vertical portion 66 that connects to a feed line and a horizontal portion 68. The feed line portion 42 also has mounting locations 70 on the horizontal portion 68.

Figure 4A:
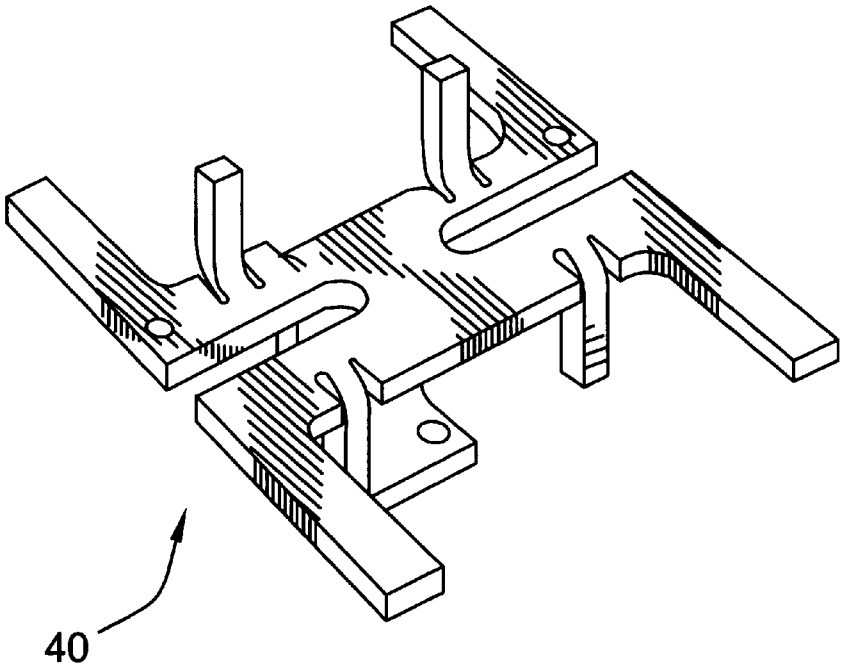
FIG. 4 shows a perspective view of the multi-dipole element and feed line portion of FIG. 2 after the bending operation.
Figure 4B:
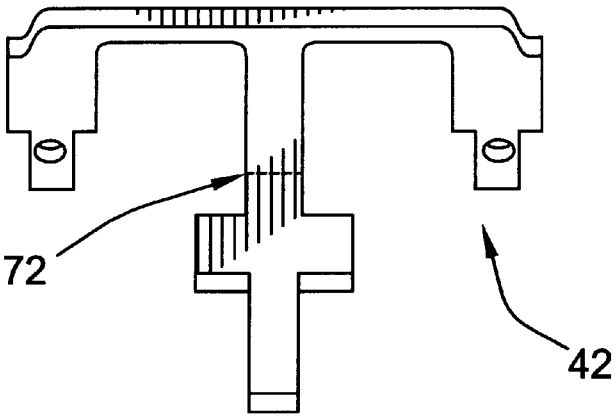

After performing a bending operation along bending locations 72, the multi-dipole element 40 and feed line portion 42 appear as shown in FIG. 4. The multi-dipole element 40 and feed line portion 42 are then assembled into a dipole unit and installed onto a reflector plate. Alternatively, the multi-dipole element 40 may be installed onto a reflector plate prior to the feed line portion 42 being operably connected to the dipole element 40.

The tabs 54, 56, 58, 60 are bent in such a way to form a symmetrical axis along the center of the slot 62. During operation of the antenna system 20, the current flowing around the slot 62 creates a magnetic field which results in the generation of an electromagnetic signal which may interfere with the operation of the antenna system 20. The length of the tabs 54, 56, 58, 60 is dependent on the width of the slot and the width $W_1$ and is selected so that the tabs interfere with the electromagnetic signal generated at the slot 62, in effect acting like a filter. In one embodiment, the length is set to approximately one eighth of a wavelength. The tabs 54, 56, 58, 60 are bent at a ninety degree angle with respect to the horizontal portion 52 and at a zero degree angle with respect to the vertical portion 50. It should be noted that the tabs can be set at any angle. For example, the tabs could located at a position that is at a forty five degree angle from the plane in which the horizontal portion 52 is located and that is parallel to the legs 51 of the horizontal portion.

Figure 5:
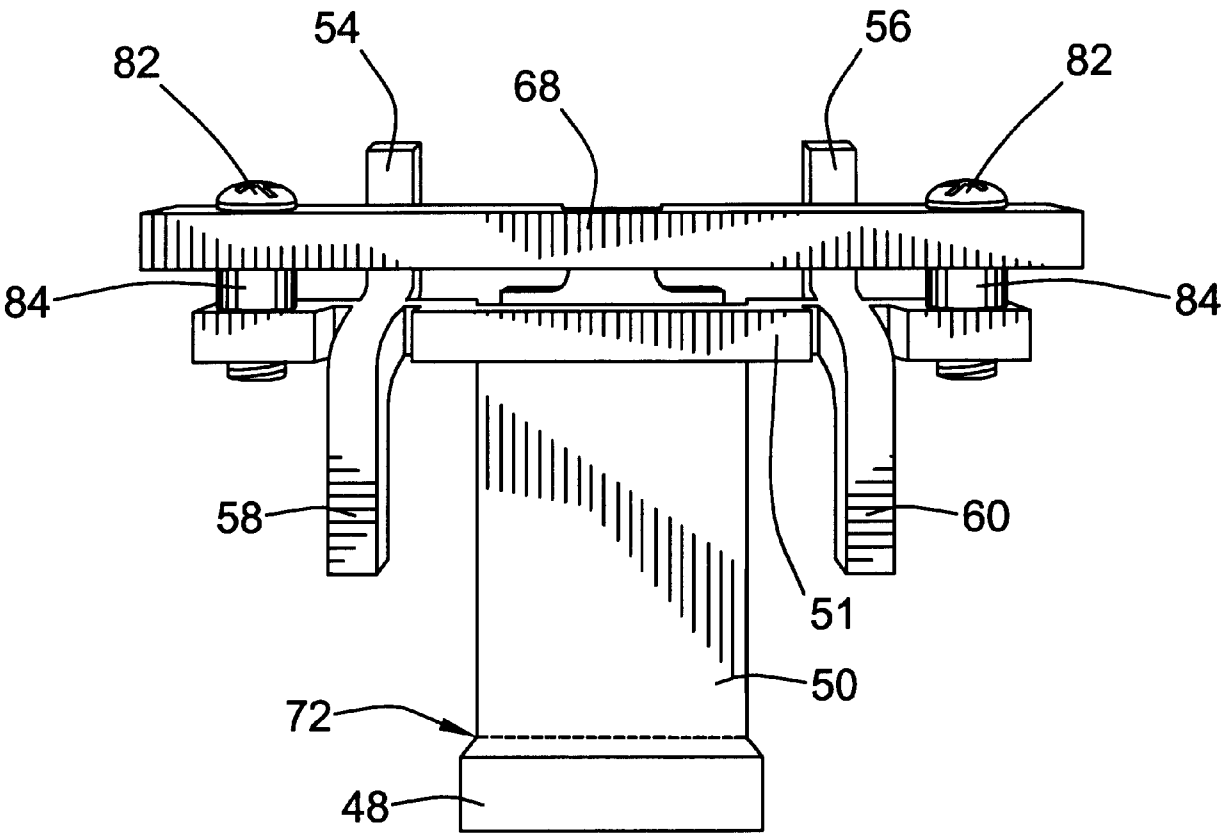
FIG. 5 is a front elevational view of the multi-dipole element and feeder portion of FIG. 4.
Figure 6:
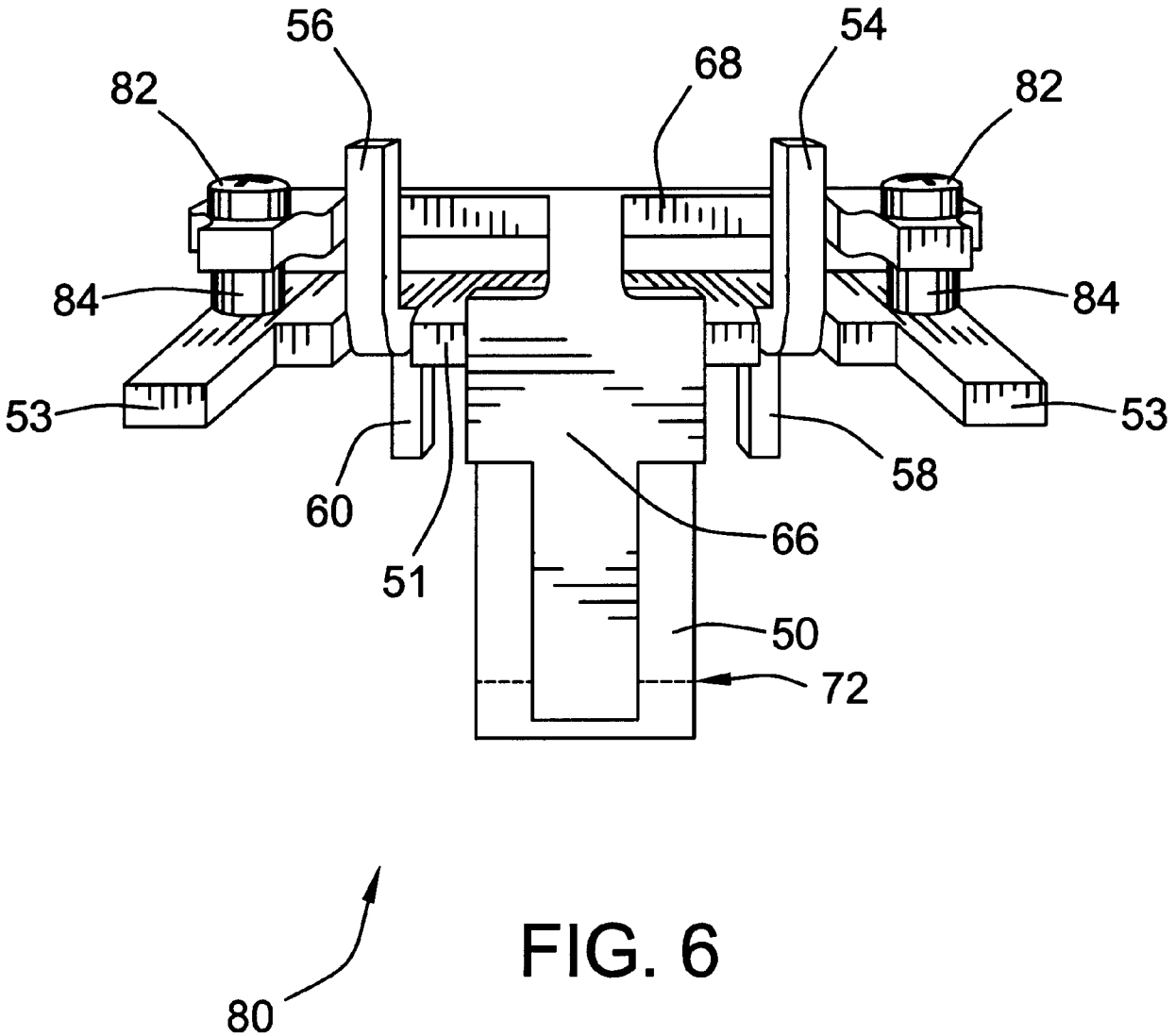
FIG. 6 is a rear elevational view of the multi-dipole element and feeder portion of FIG. 4.
Figure 7:
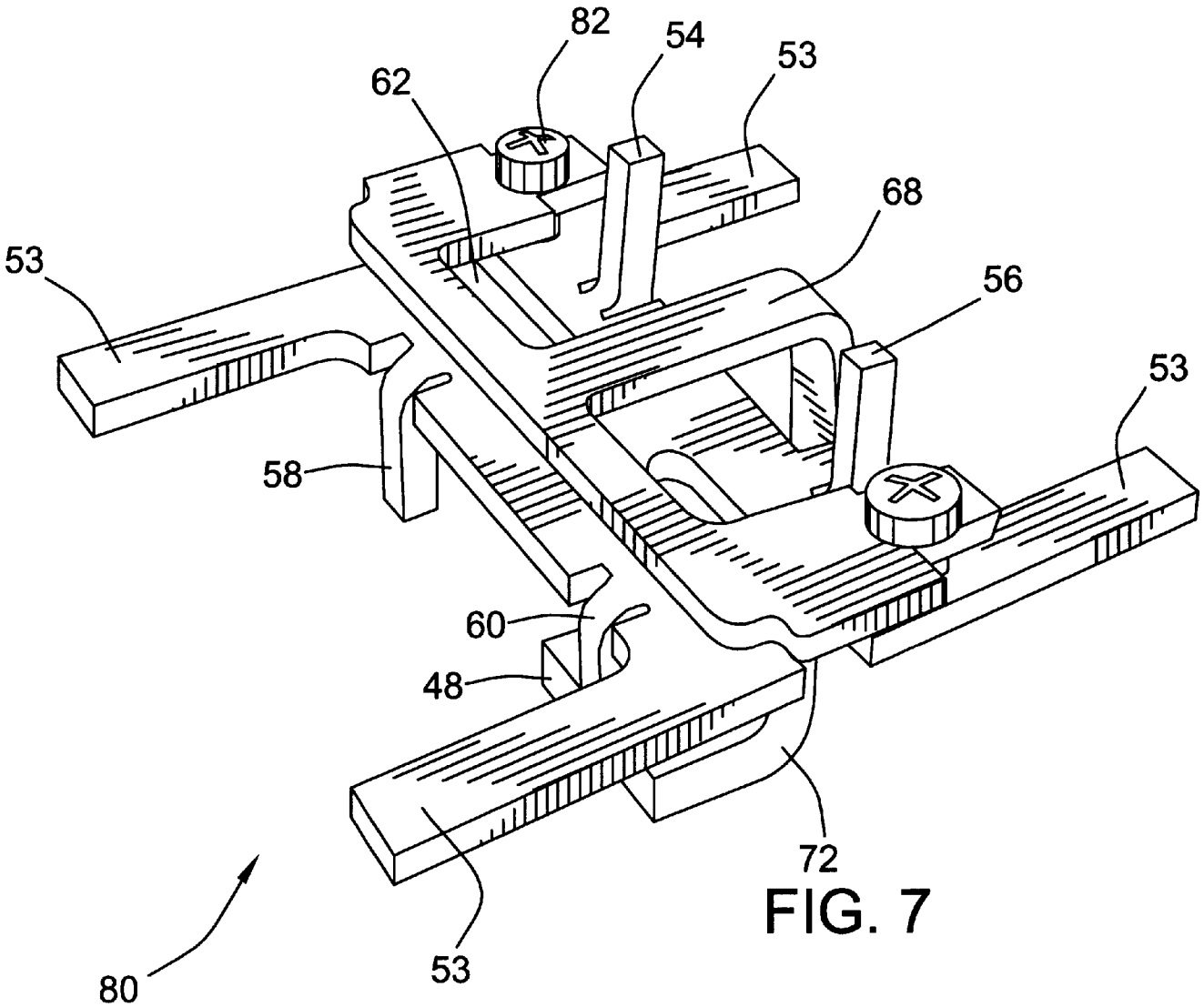
FIG. 7 is a front-right perspective view of the multi-dipole element and feeder portion of FIG. 4.
Figure 8:
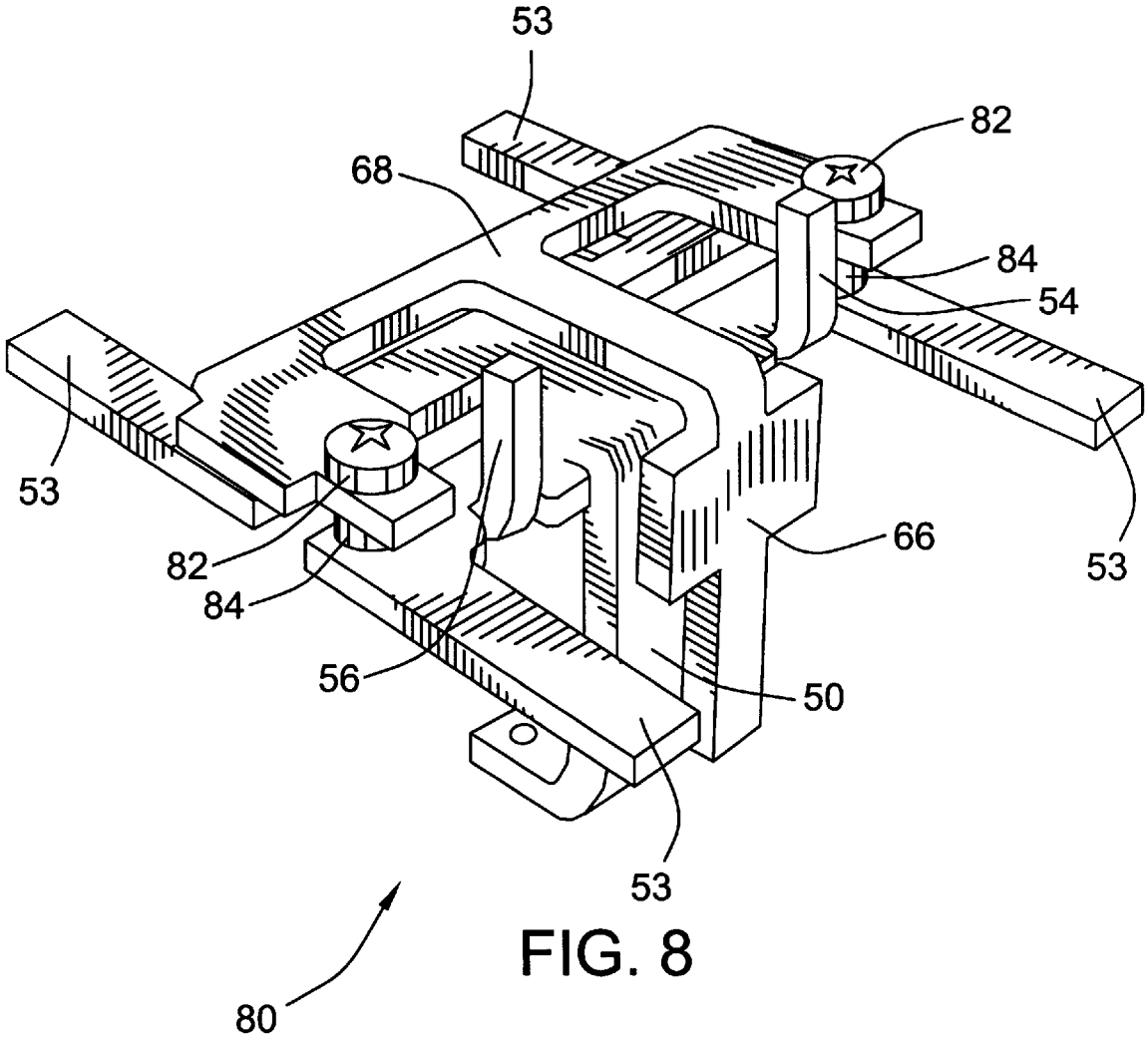
FIG. 8 is a rear-left perspective view of the multi-dipole element and feeder portion of FIG. 4.

A multi-dipole unit 80 is shown in FIG. 5 to FIG. 8 prior to installation onto a reflector plate. FIG. 5 is a front elevational view of the multi-dipole unit 80, FIG. 6 is a rear elevational view of the multi-dipole unit 80, FIG. 7 is a front-right perspective view of the multi-dipole unit 80, and FIG. 8 is a rear-left perspective view of the multi-dipole unit 80. As can be seen, the horizontal portion 68 of the feed line portion 42 is located in parallel on top of the radiation portion 52 of the multi-dipole element 40 and the vertical portion 66 of the feed line portion 42 is located in parallel of the multi-dipole support 50 of the multi-dipole element 40 on the opposite side of the support portion 48. Alternatively, the horizontal portion 68 of the feed line portion 42 may be located underneath the radiation portion 52 of the multi-dipole element 40. The vertical portion 66 of the feed line portion 42 may be located on the same side of the multi-dipole support 50 of the multi-dipole element 40 in which the mounting support portion 48 is located. For feed line portions that are of insufficient thickness to be held into place, a spacer may be installed along the vertical portion 66 of the feed line portion 42 or along the multi-dipole support 50 of the multi-dipole element 40 so that the feed line portion 42 is offset from the multi-dipole element 40 at the proper spacing.

In the embodiment shown, the horizontal portion 68 of the feed line portion 42 is connected to the multi-dipole element 40 by screws 82 and is offset by spacers 84. In this embodiment, the multi-dipole element 40 is drilled and tapped at mounting locations 64 and a locator hole is drilled, etched, or punched at mounting locations 70 of the feed line portion 42. In other embodiments, the mounting locations 70 can be tapped and a locator hole provided at mounting locations 64. Alternative methods can also be used. For example, a threaded connection of the appropriate length could be provided at either mounting location 64 or mounting location 70 and a locator hole provided at the other mounting location such that the feed line portion 42 may be bolted to the dipole element 40. Additionally, an internally threaded spacer could be provided at one of the mounting locations and a locator hole provided at the other mounting location such that the multi-dipole element 40 and feed line portion 42 are held together by screws.

Figure 9:
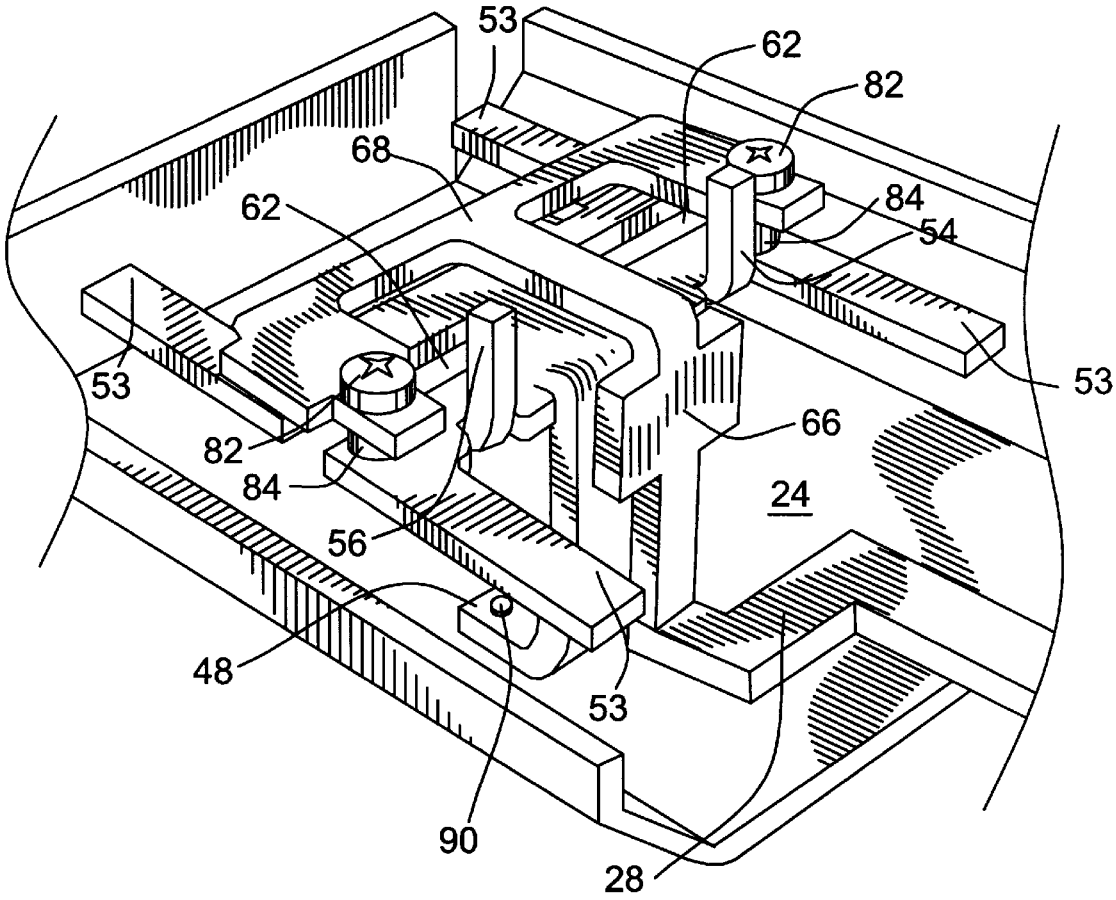
FIG. 9 is an enlarged view of a portion of FIG. 8 showing a feeder line attached to the feeder portion.

Turning now to FIG. 9, the multi-dipole unit 80 is shown installed. The mounting support portion 48 of the multi-dipole element 40 is connected to a reflector plate 24. The multi-dipole element 40 may be connected to the reflector plate 24 by any suitable means. In the embodiment shown, the mounting support portion 48 has threaded holes 49 and the multi-dipole element is connected to the reflector plate 24 via screws 92. In other embodiments, it could be welded, bonded, glued, riveted, etc. The vertical portion 66 of the feed line portion 42 is connected to the feed line 28 (refer to FIG. 1) by soldering, welding, or other suitable means.

Figure 10:
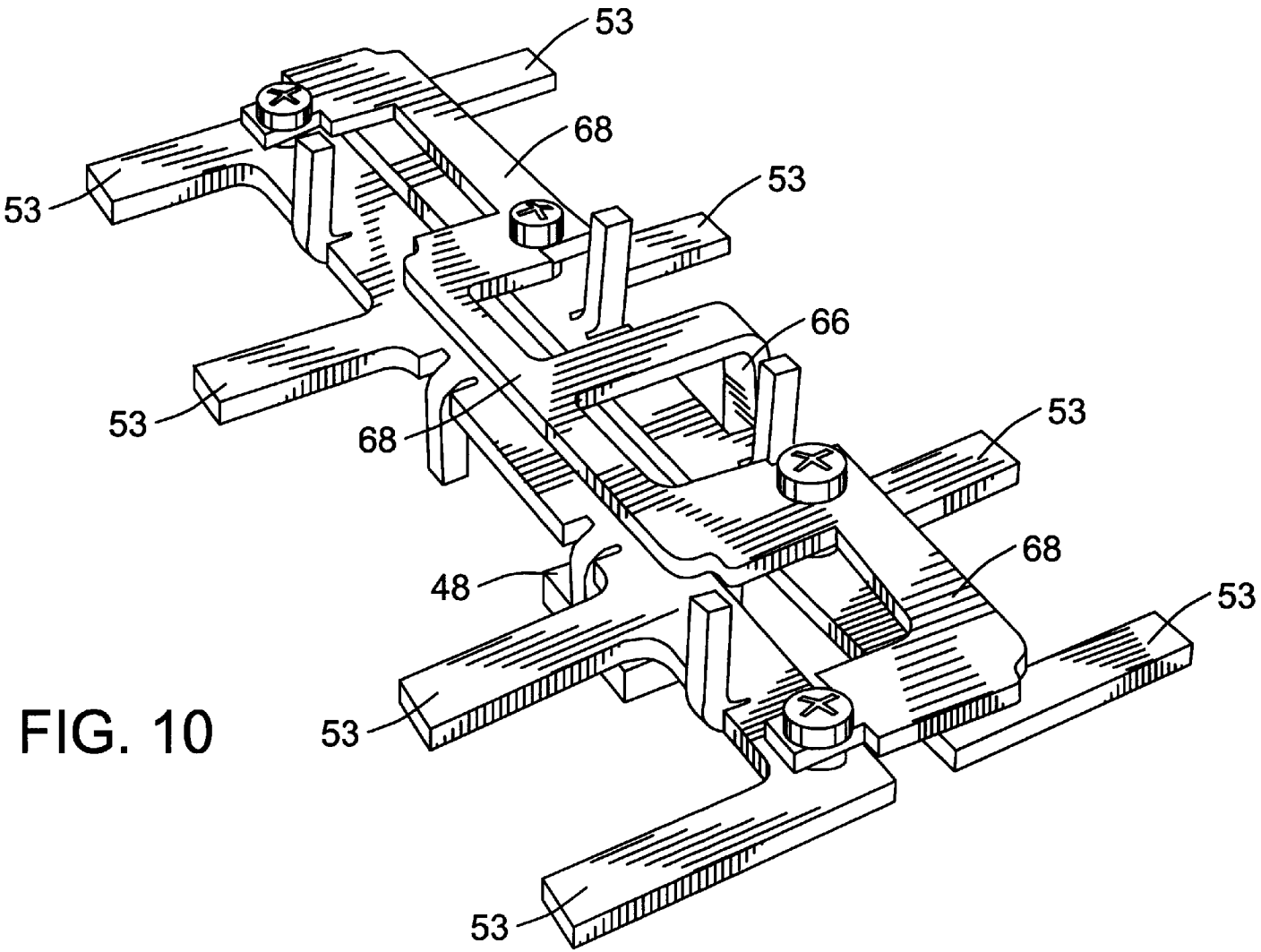
FIG. 10 illustrates an embodiment in which an additional dipole element is fabricated from one piece.

As previously mentioned, the multi-dipole element 40 and feed line portion may be made of any shape or form. The feed line portion 42 can be configured to change the power flow to the dipole element 40. For example, the horizontal portion 68 may be asymmetrical so that power flow is unequal between the arms 53. The number of arms 53 and tabs and the corresponding feed line portion can also be increased both vertically and horizontally to increase the gain or change the lobe, lobe rate, and radiation pattern of the antenna. For example, FIG. 10 shows the multi-dipole element and feed line portion of FIG. 8 "doubled." FIG. 10 shows four dipoles made from one piece. The feed line portion is routed to account for the phase lag which results from the length of the multi-dipole element and feed line portion.

Figure 11:
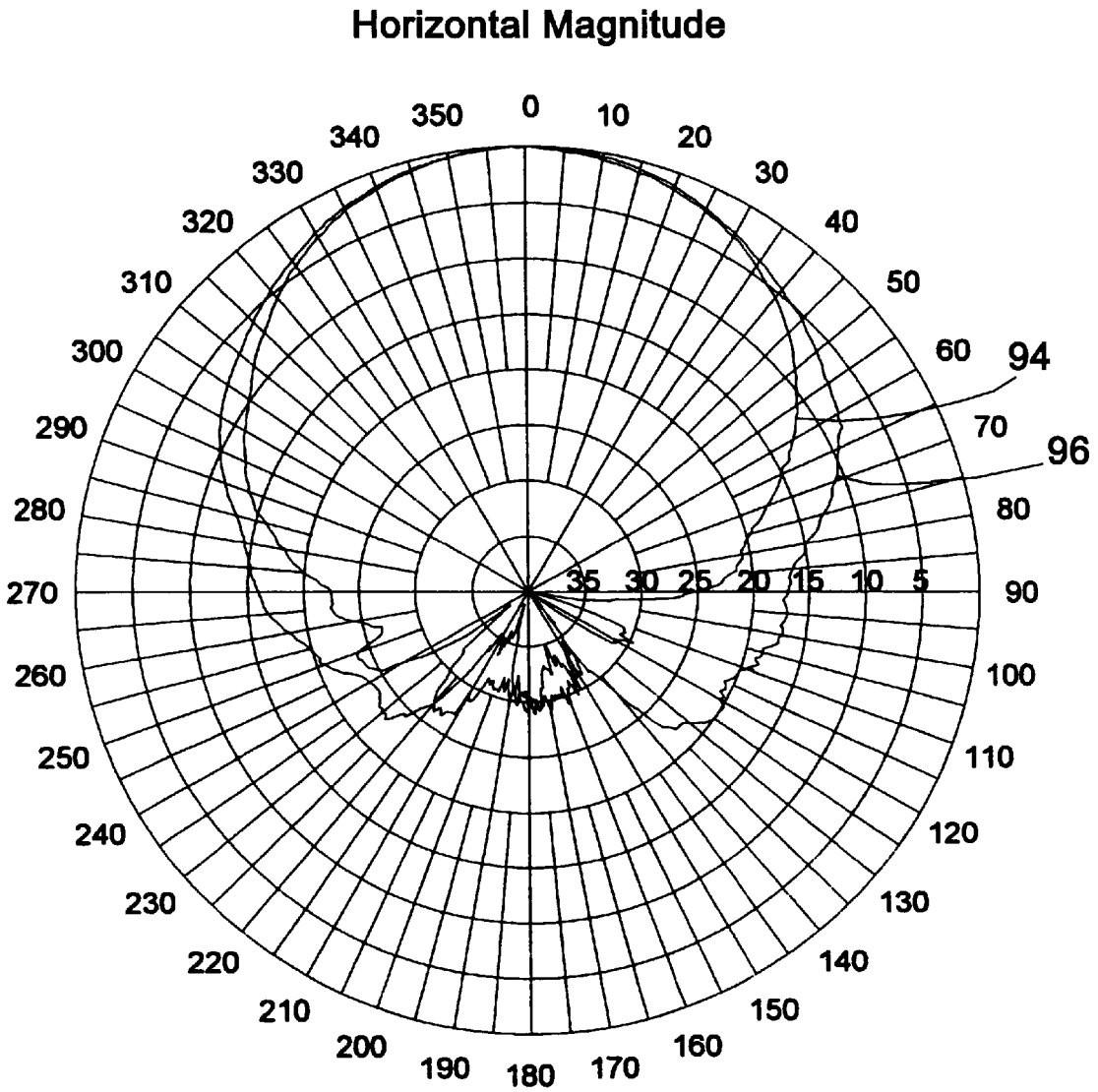
FIG. 11 shows a magnitude plot that compares a prior art antenna design with a design in accordance with the instant invention.

FIG. 11 shows the difference between the prior art design and the design in accordance with the instant invention. As can be seen by the plot, the attenuation 94 of the single piece multi-dipole design in accordance with the instant invention has a better attenuation 96 than the prior art design, which comprises two individual dipole elements and associated feed line. The gain of the design with the one piece multi-dipole element 40 and feed line portion 42 falls off much quicker than the prior art design. The instant invention provides a significant improvement in cross polarization discrimination of the antenna system 20 and also improves the isolation between adjacent horizontally positioned antennas.

The foregoing description of various preferred embodiments of the invention has been presented for purposes of illustration and description. It is not intended to be exhaustive or to limit the invention to the precise forms disclosed. Obvious modifications or variations are possible in light of the above teachings. For example, the dipole element and feed line portion may be die-cast. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An antenna system having an electrically conducting reflector plate and a connector attached to the reflector plate, the antenna system comprising:

at least one multiple dipole element attached to the electrically conducting reflector plate, said at least one multiple dipole element is formed from a single piece of electrically conducting material, said at least one multiple dipole element comprises:

a dipole support integral with a mounting support; and a plurality of dipole elements integrally connected to said dipole support; and a feed line connected to the connector and to each of the at least one multiple dipole element, the feed line placed above the reflector plate, the feed line comprises a common feed line and a dipole feed line, said dipole feed line is formed from a single piece of electrically conducting material, said dipole feed line comprises a vertical portion and a horizontal portion integral to said vertical portion, said horizontal portion having a plurality of arms and at least one leg, said horizontal portion mounted in fixed relation to said plurality of dipole elements, said vertical portion connected to the common feed line.

2. The antenna system of claim 1 wherein said vertical portion is located between said plurality of arms.

3. The antenna system of claim 1 wherein said plurality of dipole elements has a plurality of slots formed therewith, each dipole element having at least one leg and at least two arms, each dipole element further comprises at least one tab integral with said at least one leg, the at least one tab located between the at least two arms.

4. The antenna system of claim 3 wherein said at least one tab is bent at an angle in relation to a plane formed by said plurality of dipole elements.

5. The antenna system of claim 4 wherein the angle is approximately ninety degrees.

6. The antenna system of claim 3 wherein the at least one tab is bent to a location that is parallel to the at least one leg and that is at an approximately forty five degree angle in relation to a plane formed by the plurality of dipole elements.

7. The antenna system of claim 3 wherein at least one of said at least one tab of a dipole element is symmetrical about an axis with at least one of said at least one tab of one other dipole element.

8. The antenna system of claim 7 wherein the axis is centered around at least one of said plurality of slots.

9. The antenna system of claim 1 wherein said multiple dipole element is die-cast.

* * * * *